US005961749A

United States Patent [19]

Ruchel

[11] Patent Number: 5,961,749

[45] Date of Patent: Oct. 5, 1999

[54] USE OF A BRASS ALLOY FOR SANITARY PIPES

[75] Inventor: Peter Ruchel, Lauf, Germany

[73] Assignee: Diehl Stiftung & Co., Nuremberg, Germany

[21] Appl. No.: 09/064,497

[22] Filed: Apr. 22, 1998

[30] Foreign Application Priority Data

May 30, 1997 [DE] Germany ..... 197 22 827

[51] Int. Cl.[6] ..... C22C 9/08

[52] U.S. Cl. ..... 148/434; 420/477

[58] Field of Search ..... 420/477; 148/434

[56] References Cited

U.S. PATENT DOCUMENTS

| | | | |
|---|---|---|---|
| 3,963,526 | 6/1976 | Lunn | 148/554 |
| 5,445,687 | 8/1995 | Sukegawa et al. | 148/433 |
| 5,507,885 | 4/1996 | Sakai et al. | 148/434 |

FOREIGN PATENT DOCUMENTS

| | | |
|---|---|---|
| 2506334 | 11/1982 | France . |
| 55-097443 | 7/1980 | Japan . |
| 60-194035 | 10/1985 | Japan . |
| 62-278242 | 12/1987 | Japan . |
| 7-197152 | 8/1995 | Japan . |
| 8908725 | 9/1989 | WIPO . |

OTHER PUBLICATIONS

Bowers, J.E; Oseland, P.W.R.; Davies, G.C. "Development of a hot–stamping brass resistant to dezincification," Br. Corros. J. (1978), 13(4), 177–85 (provided abstract only).

*Primary Examiner*—Sikyin Ip
*Attorney, Agent, or Firm*—Scully, Scott, Murphy & Presser

[57] ABSTRACT

The invention relates to the use of a brass alloy with a high degree of cold workability for sanitary pipes, comprising 60.5–63.2% Cu, 2%–3.7% Pb, the balance Zn, plus normal impurities, wherein the effective copper equivalent is 63%–64.5% Cu. The use of cheap scrap in production of the alloy is possible by virtue of admitting lead and impurities. A very good degree of cold workability is afforded by virtue of the copper equivalent which is comparable to that of MS 63. The use of cheap return scrap causes the production costs for the alloy to be significantly below those of MS 63.

1 Claim, No Drawings

USE OF A BRASS ALLOY FOR SANITARY PIPES

BACKGROUND OF THE INVENTION

1. Field of the Invention

The invention concerns the use of a brass alloy with a high degree of cold workability for sanitary pipes. In the present context sanitary pipes are those which are used preferably in a domestic situation in the first stage of disposing of waste water or sewage, more specifically in the trap region. They involve thin-wall pipes of about 0.4–1 mm wall thickness which, in accordance with their use as components which in part are severely curved, must have a high level of bendability, that is to say cold shapeability. The pipes must have a good surface and must be chromium-plateable.

2. Discussion of the Prior Art

Hitherto brasses of the composition Cu 63, Zn 37—referred for the sake of brevity as MS 63—with a high level of purity are used for such sanitary pipes. Those brasses have the above-mentioned advantageous properties and in particular very good cold-shapeability, but they are very expensive. That is due in particular to the fact that there is no scrap or waste return for re-use. As MS 63 is used essentially only for processing involving shape-changing procedures and is not employed for cutting machining procedures, such scrap also scarcely occurs. Therefore a noticeable reduction in price in connection with sanitary pipes can be achieved only if an alloy is found, which contains cheap scrap materials and which nonetheless can be satisfactorily cold-shaped.

The wide-spread so-called machining brasses, namely those which can be subjected to cutting machining on automatic machines have a copper content of about 58–60%. They are very inexpensive as there is a large scrap circulation, both nationally and internationally. Those brasses have a content of about 2–4% lead and possibly iron as an impurity. Such scrap materials are therefore not suitable for the production of the high-purity MS 63-brasses.

SUMMARY OF THE INVENTION

Now the object of the present invention is to provide an alloy which has the cold-shapeability of for example MS 63-brasses but which is substantially less expensive to produce by virtue of the use of cheap scrap materials.

It has been found that an alloy comprising 60.5%–63.2% Cu, 2%–3.7% Pb, and the balance Zn, plus normal impurities, wherein the effective copper equivalent is 63%–64.5% Cu, attains the specified object.

The realisation was therefore that the alloy according to the invention must have a copper equivalent approximately to that of MS 63, but by virtue of the impurities contained in the alloy, in particular lead, it has a lower actual copper content and nonetheless enjoys adequate cold-shapeability. In actual fact the alloy according to the invention achieves degrees of elongation at fracture of 50% whereas comparable values in relation to MS 63 are at about 60%.

Developments of the invention provide that the alloy contains as impurity up to 0.35% Fe and in addition or instead 0.02%–0.2% As or P to guarantee a good resistance to dezincking.

The usefulness of brasses of the above-indicated composition for sanitary pipes was already surprising for the reason that poor cold-shapeability was specified in the corresponding U.S.-standards, for example in relation to MS 62 which is used in many cases in the U.S.A. In Germany also the shapeability of machining brasses, even with a relatively high copper content, that is to say 60% to 61%, was affirmed only to a very limited degree. In this respect the men skilled in the art took the view that alloys of MS 63 were the first choice for sanitary pipes, whereas alloys from the range of machining brasses were unsuitable for that purpose. Those advantageous properties of MS 63 resulted in a mental block in terms of investigating other suitable alloys in the related area. The use of lead in brass was undesirable because of the embrittlement effect which occurs in particular when alloys with a high copper content are subjected to hot rolling. As the hot rolling procedure was previously more to the forefront, considerations of that nature had a lasting influence along those lines on the standardisation of brass compositions of that kind. Although it is known that, with the compositions in question, less delicate structures occur in the hot working operation due to rather more zinc content, the strict impurity requirements in regard to lead for example were nonetheless not reviewed. As MS 63 with its high level of purity best satisfied all requirements in regard to cold shaping, there was no need to conduct investigations in an area which did not involve the expectation of good or at least comparable results. The realisation that alloys with a copper equivalent in a range such as MS 63 but in contrast thereto with alloying additives and impurities have approximately similar cold shaping properties to MS 63 provides a new possible way of affording suitable materials for sanitary pipes at a markedly lower price than MS 63.

In regard to the copper equivalent range which is very narrowly set, it is to be noted that in ranges with a higher copper content, the alloy can be increasingly poorly extruded to give the necessary thin wall thicknesses for the pipes; either largerpresses or a plurality of passes in the processing procedure are required. In both cases however economy of production suffers as a result. Although therefore in principle the cold shapeability rises with higher copper contents, that alloy range is no longer suitable for the present purpose of particularly economical production of the pipes. With low copper equivalents, the alloy comes directly into the range of copper contents of 58–60% which in fact are not suitable for cold shaping in the present context.

In regard to the definition of the copper equivalent, it is to be emphasised that, in the case of certain elements such as lead or iron, those contents are to be added to the copper content in terms of the actual effectiveness of the copper in the alloy. That results in the two formulae set out hereinafter for calculation of the minimum and maximum actual copper content with a predetermined copper equivalent which is to be between 63.0 and 64.5%:

$$Cu_{min} = \frac{100 - Pb\ (\%) - Fe\ (\%)}{100} \times Cu'_{min}$$

$$Cu_{max} = \frac{100 - Pb\ (\%)}{100} \times Cu'_{max}$$

If the contents of lead and possibly iron, which are provided in accordance with the invention, are inserted for the extreme values, then that gives the two calculation formulae set out below:

$$Cu_{min} = \frac{100 - 3.7 - 0.3}{100} \times 63 = 60.5\%$$

$$Cu_{max} = \frac{100 - 2.0}{100} \times 64.5 = 63.2\%$$

That gives 60.5% as the minimum value of the copper content and 63.2% as the maximum value for the copper. The minimum value for copper occurs with a high lead and iron content while the maximum value for the copper content occurs with the minimum value for lead without further impurities.

Upon annealing of the alloy at a temperature of 640° over a period of 10–40 minutes, degrees of elongation of between 52 and 57% have been reached, with a grain size of between 25 and 30 $\mu$m. Production of the pipes from the alloy is possible without involving an additional amount of work in comparison with pipes consisting of MS 63 so that no additional production costs are involved here. The lower costs of the initial material therefore have their full effect on the end product. In order to make the sanitary pipes resistant to dezincking, an addition of 0.02–0.2 arsenic or phosphorus is recommended.

I claim:

1. A sanitary pipe having a high degree of bendability comprising a brass alloy, said brass alloy consists of 60.5–63.2% Cu, 2–3.7% Pb, up to 0.35% Fe as an impurity, the balance Zn, plus other normal impurities, wherein the effective copper equivalent is 63–64.5% Cu.

* * * * *